US012735977B2

(12) United States Patent
Younger et al.

(10) Patent No.: US 12,735,977 B2
(45) Date of Patent: Sep. 15, 2026

(54) SYSTEMS FOR THERMALLY INSULATING SENSITIVE DOWNHOLE EQUIPMENT

(71) Applicant: SAUDI ARABIAN OIL COMPANY, Dhahran (SA)

(72) Inventors: Rae Andrew Younger, Westhill (GB); Jamie Cochran, Westhill (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 109 days.

(21) Appl. No.: 18/405,702

(22) Filed: Jan. 5, 2024

(65) Prior Publication Data

US 2025/0223901 A1 Jul. 10, 2025

(51) Int. Cl.
*E21B 47/017* (2012.01)

(52) U.S. Cl.
CPC ..... *E21B 47/017* (2020.05)

(58) Field of Classification Search
CPC ..... E21B 47/017; E21B 47/0175
See application file for complete search history.

(56) References Cited

U.S. PATENT DOCUMENTS

| | | | | |
|---|---|---|---|---|
| 4,568,830 | A | 2/1986 | Stromsworld et al. | |
| 4,629,888 | A * | 12/1986 | Wolk | G01V 5/04 62/260 |
| 4,933,040 | A | 6/1990 | Weslet, Jr. | |
| 5,931,000 | A * | 8/1999 | Turner | E21B 36/003 62/3.2 |
| 6,336,408 | B1 | 1/2002 | Parrott et al. | |
| 7,347,267 | B2 | 3/2008 | Morys et al. | |
| 7,540,165 | B2 | 6/2009 | DiFoggio et al. | |
| 7,921,913 | B2 | 4/2011 | Tchakarov et al. | |
| 8,699,227 | B2 | 4/2014 | Hovik | |
| 8,973,675 | B2 | 3/2015 | Herrera | |
| 10,240,453 | B2 | 3/2019 | Goodman | |
| 10,914,162 | B2 | 2/2021 | Finke et al. | |
| 10,917,983 | B2 | 2/2021 | Waggener, Jr. | |
| 11,306,578 | B2 | 4/2022 | Mannas et al. | |
| 2011/0042075 | A1 | 2/2011 | Hammami et al. | |
| 2018/0135406 | A1 | 5/2018 | Logan et al. | |

(Continued)

FOREIGN PATENT DOCUMENTS

| | | | |
|---|---|---|---|
| WO | 2015099769 | A1 | 7/2015 |
| WO | 2019204330 | A1 | 10/2019 |

OTHER PUBLICATIONS

Written Opinion and International Search Report form corresponding PCT Application No. PCT/US2025/010103 mailed Mar. 21, 2025.

*Primary Examiner* — Yanick A Akaragwe
(74) *Attorney, Agent, or Firm* — Vorys, Sater, Seymour and Pease LLP

(57) ABSTRACT

A downhole electronics enclosure system may include a tool body, a carrier body, a phase change media, and a support mechanism. The tool body defines an interior cavity. The carrier body may be removably provided within the interior cavity, and the carrier body may define an interior compartment for receiving electronics. The phase change media may be sealed within the interior compartment of the carrier body. The support mechanism may suspend the carrier body within the interior cavity of the tool body, such that a space is defined between an outer surface of the carrier body and an inner surface of the tool body.

20 Claims, 7 Drawing Sheets

(56) References Cited

U.S. PATENT DOCUMENTS

| | | | | |
|---|---|---|---|---|
| 2019/0316442 | A1* | 10/2019 | Rafie | E21B 36/001 |
| 2019/0368314 | A1* | 12/2019 | Tackmann | G01C 19/00 |
| 2023/0083743 | A1* | 3/2023 | Johnston | E21B 47/017 166/57 |

* cited by examiner

SYSTEMS FOR THERMALLY INSULATING SENSITIVE DOWNHOLE EQUIPMENT

FIELD OF THE DISCLOSURE

The present disclosure relates generally to tooling utilized to thermally insulate sensitive electronics and, more particularly, to tooling for thermally insulating downhole electronics and components inserted into a wellbore.

BACKGROUND OF THE DISCLOSURE

Electronics may become unreliable or may altogether cease functionality at high temperatures. Specialized electronics have been developed that are suitable for use in such high temperature applications, however, such specialized electronics are expensive, difficult to qualify/test, and may be difficult to incorporate into applications with small size requirements. Furthermore, obsolescence and parts sourcing of suitable specialized electronics poses long-term problems associated with their use. For this reason, consumer grade electronics are often utilized in certain high temperature applications even though consumer grade electronics have relatively low temperature limits, because such consumer grade electronics are inexpensive and readily obtainable.

Tooling has been developed to protect such consumer grade electronics at high temperatures. However, such tooling has many downsides when utilized in downhole applications (e.g., in the oil and gas industry). For example, such tooling is expensive, fragile and easily damaged, provided in limited geometries and shapes which thereby limits their ability to be used in various end use applications, designed in a manner making it difficult to install/remove electronics therein/therefrom, etc.

A need, therefore, exists for improved tooling that is able to thermally insulate electronics.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a downhole electronics enclosure system includes a tool body defining an interior cavity, a carrier body removably provided within the interior cavity, a phase change media, and a support mechanism. The carrier body defines an interior compartment for receiving electronics, and the phase change media is sealed within the interior compartment of the carrier body. The support mechanism suspends the carrier body within the interior cavity of the tool body, such that a space is defined between an outer surface of the carrier body and an inner surface of the tool body.

According to another embodiment of the present disclosure, a carrier for housing electronics within a downhole tool is provided. The carrier includes a carrier body, an upper end cap, a lower end cap, and a phase change media. The carrier body defines an open top end, an interior compartment, and an open bottom end, wherein the open top end and the open bottom end are in communication with the interior compartment. The upper end cap is provided at the open top end of the carrier body and generates a sealed interface with the open top end. The lower end cap is provided at the open bottom end of the carrier body and generates a sealed interface at the open bottom end. The phase change media is sealed within the interior compartment of the carrier body via the upper end cap and the lower end cap. The upper end cap and the lower end cap each include a shaft, a plurality of spokes extending from a first end of the shaft, and a base extending from a second end of the shaft. The base is disposed within either the open top end or the open bottom end of the carrier body, and the plurality of spokes radially extend from the shaft for suspending the carrier body such that heat is conducted to the carrier body through the plurality of spokes, the shaft, and the base.

In yet another embodiment consistent with the present disclosure, a method is provided. The method includes providing electronics within an interior compartment of a carrier body. The method also includes sealing a phase change media within the interior compartment via at least one end cap, wherein the carrier body having the at least one end cap sealed thereon defines a carrier. In addition, the method includes suspending the carrier within an interior cavity of a tool body, such that a space is defined between an outer surface of the carrier body and an inner surface of the tool body. Furthermore, the method includes at least partially evacuating air or gas from the space between the carrier body and the tool body.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
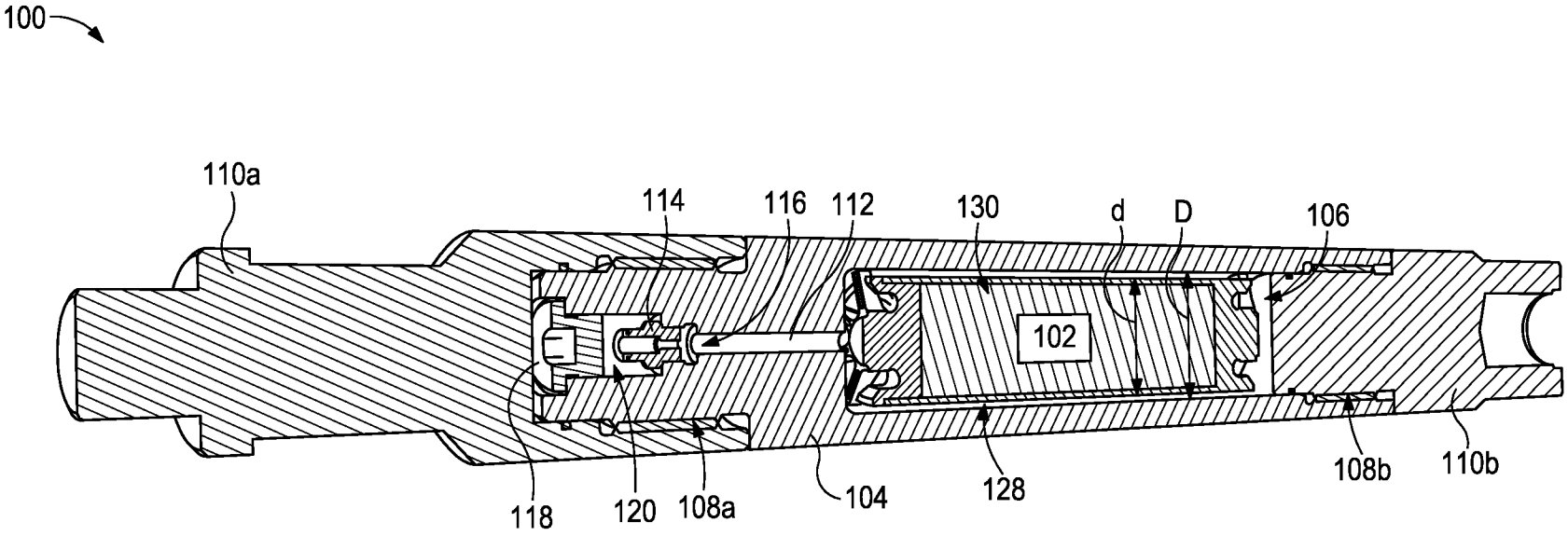
FIG. 1 is cross-sectional side view of a sensitive equipment enclosure system having at least a tool body and a carrier, according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to enclosure systems for thermally insulating downhole electronics and components inserted into a wellbore. The downhole electronics enclosure system may include a tool body defining an interior cavity, a carrier removably provided within the interior cavity, a phase change media, and a support mechanism. The carrier may define an open top end, an interior compartment for receiving the electronics, and an open bottom end, wherein the open top end and the open bottom end are in communication with the interior compartment. The phase change media is sealingly provided in the interior compartment of the carrier, and the support mechanism suspends the carrier within the interior cavity of the tool body. After the carrier is provided in the interior cavity of the tool body, the interior cavity of the tool body may be evacuated of air such that a vacuum is formed so as to inhibit heat transfer, as described herein. In embodiments, the support mechanism comprises a pair of end caps on the open top end and the open bottom end of the carrier to provide sealed interfaces, such that the phase change media is sealed therein. In such embodiments, the end caps may have geometry that reduces contact area between the carrier and the tool body and that provides a tortuous path for heat conduction therebetween.

Embodiments described herein may offer several advantages. For example, standard (consumer grade) electronics could be utilized in oilfield equipment intended for use downhole. This may allow a wider range of electronics and electronic components to be used, and hardware could be cheaper and simpler to develop, qualify, and test. Furthermore, the embodiments discussed herein may enable the use of lower operating temperature batteries, which may be less hazardous, easier to transport, and/or easier to dispose of. This may also enable temperature-sensitive devices and hardware to be deployed, which could present new opportunities for tools not currently possible. Lastly, the operating time for specialized high temperature hardware could be further extended beyond what is currently possible. For example, a tool might be required to deploy a chemical, where the rate at which a chemical reaction progresses is often temperature dependent. Thermal insulation (as described herein) could delay any reaction rate increase, thereby allowing a wider range of chemicals to be utilized and deployed for oil and gas applications.

FIG. 1 illustrates an example enclosure system 100, according to one or more embodiments of the present disclosure. As hereinafter described, the enclosure system (hereinafter, the "system 100") may be utilized to protect, isolate, and thermally insulate sensitive equipment housed therein, such as electronics 102. While FIG. 1 illustrates the system 100 being utilized to protect the electronics 102, it should be appreciated that the system 100 may be utilized to protect various types of equipment, sensors, tools, etc. without departing from the present disclosure.

In the illustrated embodiment, the system 100 includes a tool body 104 that defines an interior cavity 106. The tool body 104 includes an open upper end 108*a* and an open lower end 108*b* opposite the open upper end 108*a*. Here, the interior cavity 106 of the tool body 104 is accessible via either or both of the open upper end 108*a* and/or the open lower end 108*b*. In other embodiments, however, only one of the upper and lower ends 108*a,b* may be open, thus making the interior cavity 106 accessible via just one of the upper or lower ends 108*a,b*.

The system 100 may also include an upper bulkhead 110*a* provided over (arranged at) the open upper end 108*a* of the tool body 104, and a lower bulkhead 110*b* provided over (arranged at) the open lower end 108*b* of the tool body 104. Thus, the upper bulkhead 110*a* and the lower bulkhead 110*b* (collectively, the bulkheads 110) function to enclose and seal the interior cavity 106 of the tool body 104. In embodiments where the tool body 104 includes just one open end (e.g., one of the upper end 108*a* or the lower end 108*b*), the system 100 may include a corresponding single bulkhead for covering that opening and thereby enclosing the interior cavity 106 of the tool body 104. In embodiments, either or both of the bulkheads 110*a,b* and/or the tool body 104 may have a pressure-sealable opening through which wires (e.g., electrical wires, fiber optic cables, hydraulic lines, etc.) may be passed to access the electronics 102 contained therein. For example, the bulkheads 110*a,b* may have openings through which wires may be passed so that an interior of the tool body 104 may be accessed, and then such openings may be sealed closed such that the interior of the tool body 104 is pressurized while allowing for communication therewith.

The tool body 104 may be a relatively thick-walled structure that is operable to protect the electronics 102 (or other sensitive equipment) from impact. In addition, the tool body 104 may be pressurized to assist in thermally insulating the electronics 102. In the illustrated embodiment, the tool body 104 includes a channel 112 extending from the open upper end 108*a* into the interior cavity 106 of the tool body 104, and a vacuum port 114 provided at an opening 116 of the channel 112. During use, the lower bulkhead 110*b* may be provided on the open lower end 110*b* to seal the open lower end 110*b*, and then a tool (such as a pump) may be attached to the vacuum port 114 to evacuate air from the interior cavity 106 and thereby generate a vacuum within the tool body 104. In embodiments, a sealing plug 118 may be provided in the open upper end 108*a* to cover the vacuum port 116 and provide additional sealing, for example, from downhole pressures. In the illustrated embodiment, the sealing plug 118 is removably provided over an opening 120 in the open upper end 108*a* through which the vacuum port 114 and the channel 112 may be accessed. In embodiments, the vacuum port 114 is a check valve. Where utilized, the sealing plug 118 is operable to provide an additional means of sealing the interior cavity 106, in addition to the check valve, from downhole pressures.

In the illustrated embodiment, the tool body 104 defines (provides) a single interior cavity (i.e., the interior cavity 106). However, in other embodiments, the tool body 104 may define more than one interior cavity. In such embodiments, the interior cavities may be interconnected to each other (such that they may all be evacuated of air together when generating the vacuum) or may be isolated from each other such that they will need to be individually evacuated of air when generating the vacuum. For example, in another embodiment, the tool body 104 may include a first cavity proximate to and accessible via the open upper end 108*a* and a second cavity proximate to and accessible via the open lower end 108*b*, wherein the first and second cavities are separated from each other such that a vacuum will need to be generated in each of the cavities. However, in other embodiments, the first and second cavities may be interconnected (e.g., via a channel), such that they may be evacuated of air simultaneously using a vacuum generated during a single operation (i.e., evacuating air from the first cavity will also evacuate air from the second cavity). Providing multiple connected internal cavities would advantageously allow interconnects (e.g., electric cable, fiber optic cables, hydraulic lines, etc.) between hardware in each cavity without interconnects having to pass through sealed bulkheads 110. This might allow, for example, a battery module within one cavity to be wired to the electronics within another and the tool easily and quickly made ready with a single vacuum operation.

The system 100 also includes a carrier 130 that may be provided in the interior cavity 106 of the tool body 104. The carrier 130 is removable from the interior cavity 106 of the tool body 104, and houses the electronics 102. The carrier 130 may also provide further protection and thermal insulation to the electronics 102. As shown in FIG. 1, a gap or space 128 is defined between an outer surface (e.g., outer circumference) of the carrier 130 and an inner surface of the interior cavity 106. Also, as shown, the carrier 130 defines an outer diameter d that is smaller than an inner diameter D of the interior cavity 106 of the tool body 104 such that, when the carrier 130 is disposed in the interior cavity, the space 128 is defined between the outer surface of the carrier 130 and the inner surface of the tool body 104. In the illustrated embodiment, the space 128 defined between the carrier 130 and the inner surface of the interior cavity 106 is an annular shaped space.

The space 128 may be evacuated such that a vacuum is formed therein. By creating a vacuum in the space 128, thermal convection from the tool body 104 to the carrier 130 may be reduced as thermal convection does not happen (or is at least minimized) in a vacuum. In embodiments, a gas may be injected or pumped into the space 128 before generating the vacuum therein, so as to remove moisture from the space 128 before generating the vacuum. In such embodiments, the gas pumped into the space 128 may be dry air, Nitrogen, Argon, etc. In some embodiments, all gas is completely purged from the space 128 to generate a complete vacuum. Because the rate of convective heat transfer is proportionate to the number of gas molecules present, there would be no convective heat transfer in the complete vacuum due to the absence of gas molecules. In other embodiments, a partial vacuum is generated in the space 128 defined between the carrier 130 and the inner surface of the interior cavity 106. The partial vacuum exists when the pressure within the cavity space 128 is lower than atmospheric pressure, and the partial vacuum may be achieved by filling the space 128 with one or more gases, purging the space 128 and then pulling a partial vacuum in the space 128. In such embodiments, the one or more gases may be a single gas, whereas in other embodiments, the one or more gases may be a blend of gases. The one or more gases may comprise Nitrogen, Argon, or any other gas.

In embodiments, another substance may be provided in the space 128 between the tool body 104 and the carrier 130. The substance may comprise open cell foam or Silica Aerogel. In other embodiments, the substance may comprise silica, alumina, titania, zirconia, iron oxide, chromia, vanadia, neodymium oxide, samaria, holmia, erbia, etc. In even other embodiments, flocked media may be provided in the space 128 between the tool body 104 and the carrier 130, wherein such flocked media may be glass wool, fibrous material, feather-like material, foamed material, woven material, granular material, etc. Regardless of the type of substance injected into the space 128, these substances may be injected into the space 128 in lieu of generating a vacuum in the space 128. However, in some embodiments, such substances may be provided in the space 128 in addition to forming a vacuum in the space 128.

Figure 2:
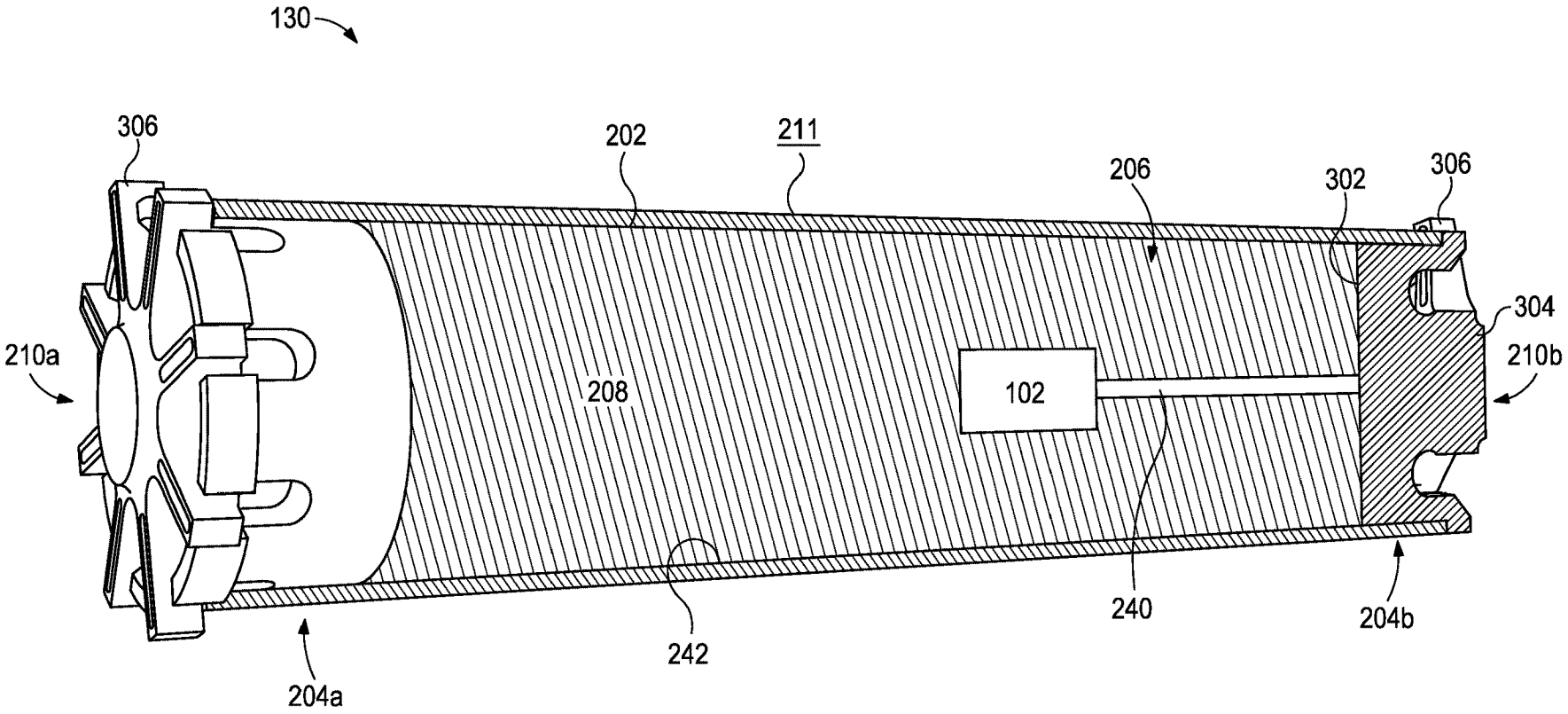
FIG. 2 is a partial cross-sectional side view of the carrier of FIG. 1.

FIG. 2 is an enlarged isometric view of the carrier 130, according to one or more embodiments. As illustrated, the carrier 130 is removed from the interior cavity 106 of the tool body 104 and includes a carrier body 202 (hereinafter, the "body 202"). The body 202 has an open top end 204*a* and an open bottom end 204*b*. The body 202 is at least partially hollow and defines an interior compartment 206 for receiving the electronics 102. In the illustrated embodiment, the interior compartment 206 is in communication with both the open top end 204*a* and the open bottom end 204*b*, such that the interior compartment 206 is accessible via either or both the open top end 204 and/or the open bottom end 204*b*. However, in other embodiments, the body 202 may define more than one interior compartment that are separate from each other. For example, the body 202 may define an upper interior compartment that is proximate to and in communication with the open top end 204*a* and a lower interior compartment that is proximate to and in communication with the open bottom end 204*b*, with the lower interior compartment being separated from the upper interior compartment such the upper interior compartment is accessible via the open top end 204*a* but not the open bottom end 204*b*, and vice versa.

The body 202 of the carrier 130 may be made from various materials. In embodiments, the body 202 is made from a plastic or metal material, but may be made from various other materials having sufficient rigidity capable of protecting the electronics 102 from impact. In some embodiments, the body 202 is made from Aluminum. The body 202 may have various shapes as well. In the illustrated embodiment, the body 202 is cylindrical and exhibits a generally circular cross-section, but could alternatively exhibit a polygonal cross-section. In embodiments, the outer surface 211 of the carrier 130 (or the body 202 thereof) may have a low emissivity, for example, by polishing, plating, coating, or painting. Thus, in some embodiments the outer surface 211 may be highly polished, and/or the outer surface of the carrier 130 may be plated or painted with a material. In embodiments, the outer surface of the carrier 130 may be plated or painted with a Chrome plating, a vapor deposition, a ceramic coating, or a gold coating. In embodiments, the outer surface of the carrier 130 may be plated or painted via High Velocity Oxygen Fuel ("HVOF") of a Chromium Carbide material. In embodiments, the outer surface of the carrier 130 may be plated or painted via anodizing. In embodiments, the outer surface of the carrier 130 may be treated with a polymer metallization, such as an electrolytic and/or electroless Nickel Plating coating process using various materials, such as nickel, gold, silver, copper, and/or other metals or allows. In embodiments, the outer surface of the carrier 130 may be plated or painted with a liquid metal paint containing ultra-fine metallic particles.

A phase change media 208 is sealed within the interior compartment 206 of the carrier 130. In the illustrated embodiment, the electronics 102 are surrounded by and in intimate contact with the phase change media 208 (hereinafter, the "media 208"); however, a coating may be provided on the electronics 102. In embodiments, the electronics 102 may be provided within a separate container that is surrounded by the media 208 such that the electronics 102 are not in direct intimate contact with the media 208. For example, the electronics 102 may be sealed in a bag or a container, with the bag or container being in intimate contact with the media 208. This will prevent the media 208 from contacting the electronics 102 and further prevent the media 208 from migrating into and between individual components of the electronics 102. This may make it easier to remove, inspect, and replace the electronics 102, as may be desired. These embodiments will also help inhibit the media 208 from electrically "shorting" the electronics 102.

The media 208 may be a material that is selected to melt below the upper temperature limit of the electronics 102 (or other heat sensitive equipment). Stated differently, the media may have a melting point that is lower than an upper limit temperature of the electronics 102, such that the media 208 will melt before the electronics 102 are impaired by the high downhole temperatures within which the system 100 is provided. The media 208 has a suitably high latent heat of solidification so that it absorbs sufficient energy on heating, so as to effectively insulate the electronics 102 from heat absorbed by the media 208.

The media 208 may comprise various types of materials. In embodiments, the media 208 is an organic material, including but not limited to waxes, oils, fatty acids and polyglycols. In some of these embodiments, the media 208 is Paraffin Wax. In some embodiments, the media 208 is a material having a melting point temperature of approximately 60 degrees Celsius.

In embodiments, the media 208 is a single type of phase change material. However, in other embodiments, the media 208 may include a plurality of phase change materials that are provided in the interior compartment 206 of the carrier 130. These plurality of phase change materials might individually change phase at different temperatures, such that the collective energy required to change phases with the multiple phase change materials might be tailored to particular requirements and applications. For example, the media 208 may include a first phase change material which changes phases at temperature T1 and a second phase change material which changes phases at elevated temperature T2. In such embodiments, after the first phase change material reaches temperature T1, changes phases, and reaches equilibrium with the external environment, the temperature may continue to rise until it reaches the elevated temperature T2 at which point the second phase change material begins to change phases, thereby providing significant period of time at which the electronics 102 may be shielded from experiencing the external environment temperatures.

In embodiments, the media 208 is a non-conductive material and/or a material with a relatively low dielectric conductivity such that, when the media 208 is in direct and intimate contact with the electronics 102 it does not cause a short circuit. However, in embodiments, the media 208 may be a conductive material(s), such as a metal or a metal alloy. In one example, the media 208 is Gallium and/or an alloy of Gallium. In such embodiments, the electronics 102 may be coated with a non-conductive material such that the media 208 will not cause a short. Alternatively, or in addition thereto, the electronics 102 may be sealed within a separate container that is surrounded by the media 208, such that the media 208 is not in intimate contact with the electronics 102 which would otherwise result in a short circuit.

In some embodiments, the media 208 may include or comprise a reactive material or contain reactive additions/particles. For example, a first cavity within media 208 (e.g., Paraffin wax) might encapsulate a first reactive chemical and a second cavity within media 208 may encapsulate a second reactive chemical, with the media 208 separating the first and second reactive chemicals from each other, such that the first and second reactive chemicals are not in physical contact with each other. However, when exposed to elevated temperatures, the media 208 melts and transitions from solid to liquid (or gas), such that the media 208 no longer separates the first and second reactive chemicals and such that the first and second reactive chemicals are able to mix together. Upon mixing of the first and second chemicals an endothermic reaction may occur. For example, the first reactive chemical may be water and the second reactive chemical may be a salt crystal chosen to produce the endothermic reaction, such as Sodium Chloride, ammonium nitrate, calcium ammonium nitrate.

In another embodiment, the media 208 may contain granular particles, such as reactive chemicals that are able to mix or combine when the media 208 melts from solid to liquid (i.e., when the media 208 liquefies), and reaction of the chemicals results in reactions as described above. In another embodiment, the media 208 comprises a first chemical and a second chemical that are separated from each other (i.e., a gap separates the first chemical from the second chemical) and, when exposed to heating, the first chemical (or the second chemical) will melt and flow into contact with the second chemical (or the first chemical), with the first chemical being reactive when in contact with the second chemical and thereby resulting in reactions such as those detailed above.

In addition, because the rate of chemical reaction changes with temperature, the chemicals and/or reagents selected for any particular embodiment may allow for a temperature dependent reaction rate which varies with phase change transition temperature. For example, the carrier 106 may be provided with different types of chemicals having different phase change characteristics. In such embodiments, the media 208 having a relatively lower temperature phase change may allow the chemical reaction to occur at a relatively lower temperature (i.e., when the media 208 melts and allows the chemicals to mix and thereby cause the chemical reaction), and the chemical reaction may proceed at a slow rate. However, using a different type of media 208 having a relatively higher temperature phase change causes the chemicals to mix at a higher temperature and the reaction then proceeds at a faster rate.

The system 100 also includes a support mechanism that suspends the carrier 130 within the interior cavity 106 of the tool body 104 such that the space 128 (FIG. 1) is defined between an outer surface 211 of the carrier 130 and the inner surface 310 (see FIG. 3) of the interior cavity 106 of the tool body 104. FIG. 2 illustrates an embodiment where the support mechanism includes an upper end cap 210*a* and a lower end cap 210*b*. In the illustrated embodiment, the upper end cap 210*a* is provided at the open top end 204*a* of the carrier 130, and the lower end cap 210*b* is provided at the open bottom end 204*b* of the carrier 130. As described below, the upper and lower end caps 210*a,b* may include features that help suspend the carrier 130 within the interior cavity 106 such that the space 128 is defined between the outer surface 211 of the carrier 130 and the inner surface 310 of the interior cavity 106. In addition, the upper end cap 210*a* seals the open top end 204*a* and the lower end cap 210*b* seals the open bottom end 204*b*, such that the media 208 is sealed and contained within the interior compartment 206 of the carrier 130.

The upper end cap 210*a* and the lower end cap 210*b* (collectively, the "end caps 210" and each, individually, the "end cap 210"), which suspend the carrier 130 within the tool body 104, assist in providing thermal insulation to the electronics 102 contained in the carrier 130. In particular, the end caps 210 provide a tortuous path for heat conduction, to thereby minimize or reduce direct heat conduction from the tool body 104 to the carrier 130. In FIG. 2, the upper end cap 210*a* is fully depicted in a perspective view, while the lower end cap 210*b* is depicted in a cross-section view together with the body 202 of the carrier 130.

Figure 3:
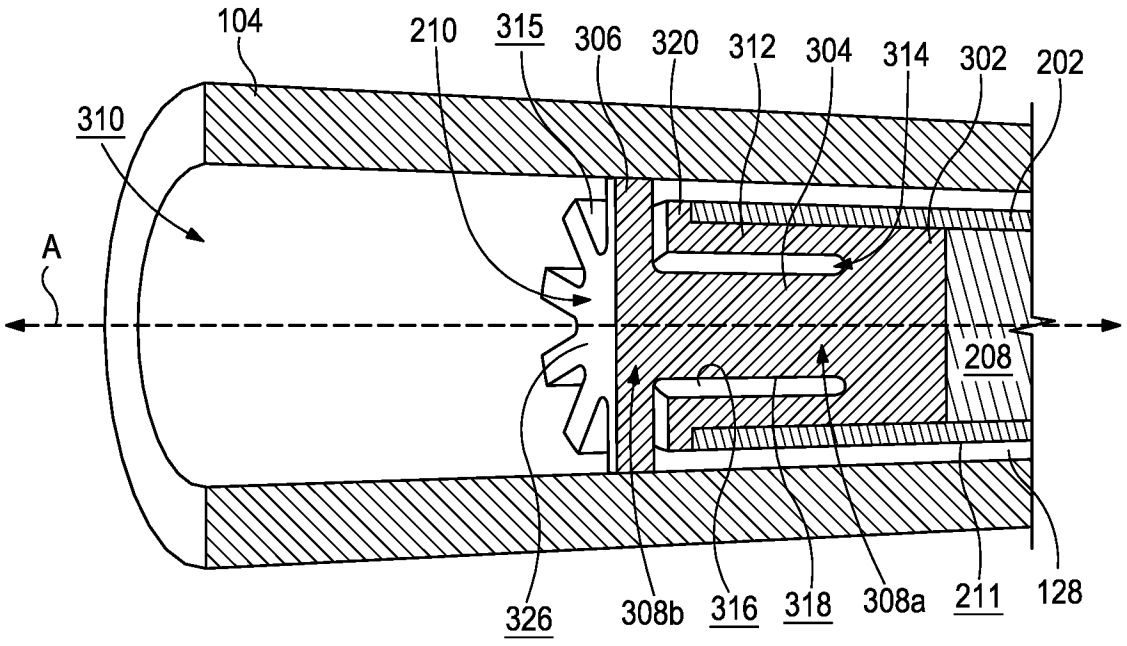
FIG. 3 schematically depicts a cross-section of one of the end caps of FIG. 2 installed in the tool body.
Figure 4:
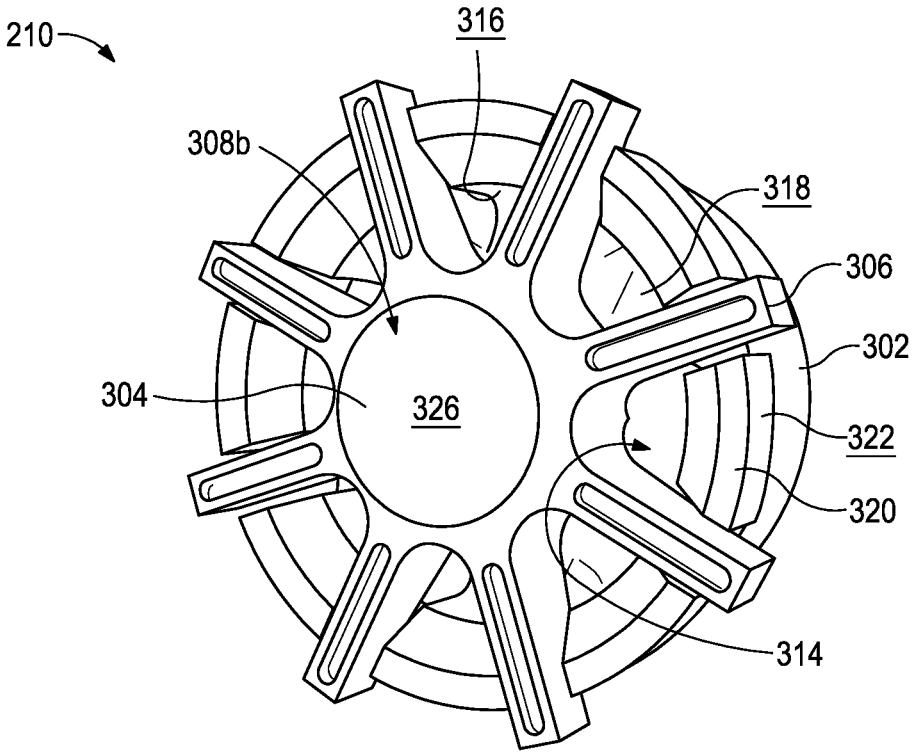
FIG. 4 is a perspective view of the end cap of FIG. 1 and FIG. 2.
Figure 5:
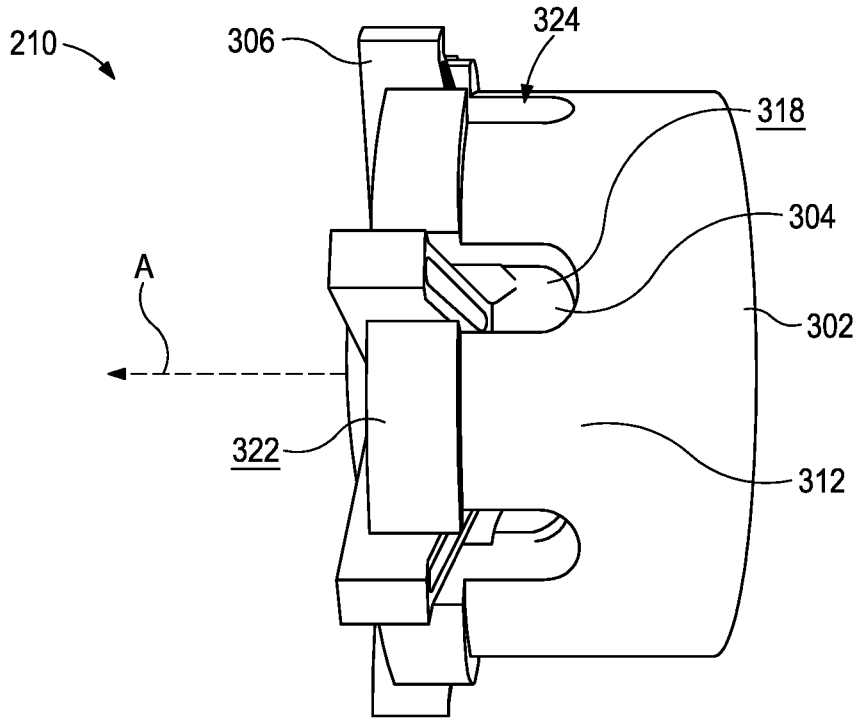
FIG. 5 is a side view of the end cap of FIG. 4.
Figure 6:
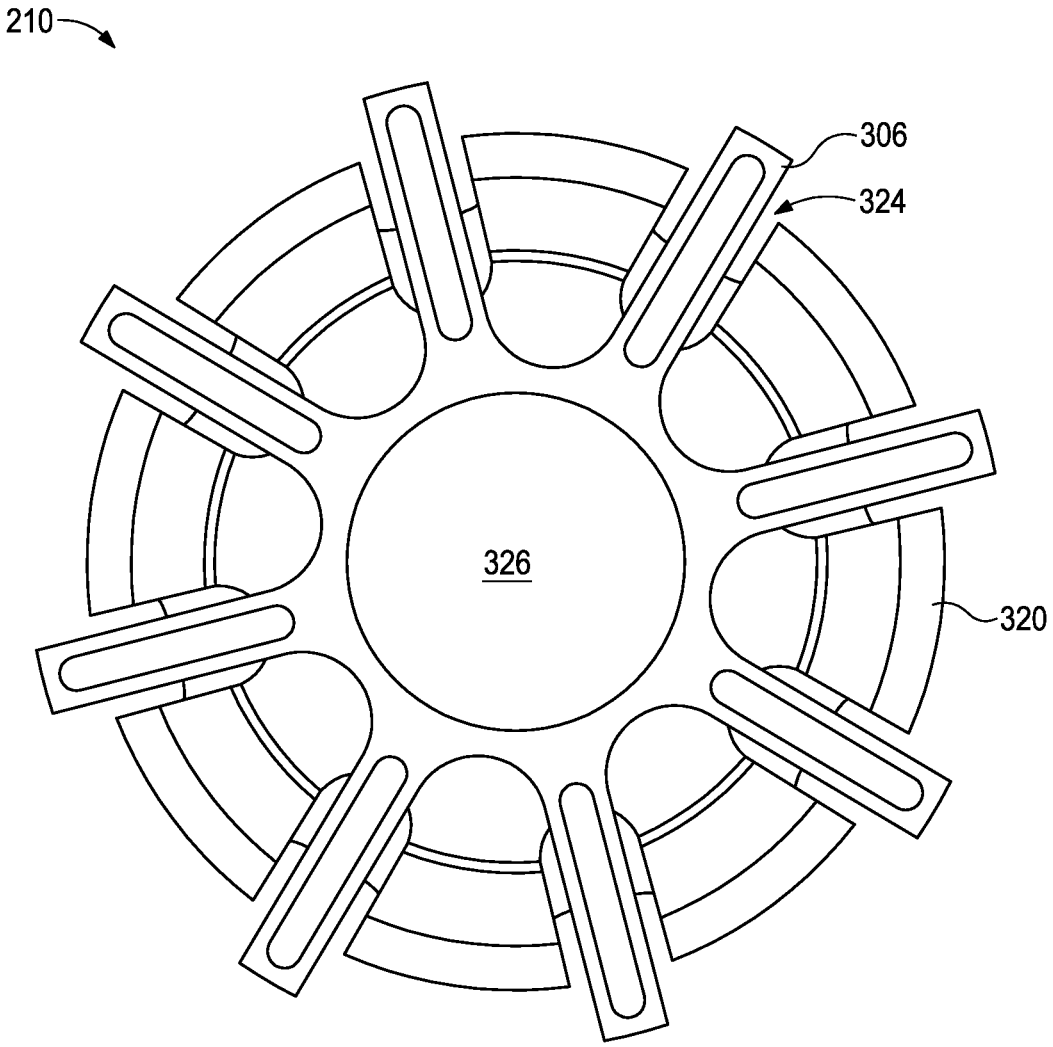
FIG. 6 is a front view of the end cap of FIG. 4.

FIG. 3 schematically depicts a cross-section of one of the end caps 210 suspending the carrier 130 within the tool body 104, according to one or more embodiments. FIG. 4 depicts a perspective view of the end cap 210, FIG. 5 depicts a side view of the end cap 210, and FIG. 6 depicts a front (end) view of the end cap 210. In the illustrated embodiment, the end cap 210 includes a base 302, a shaft 304 extending from the base 302, and a plurality of radial projections or "spokes" 306 extending radially outward from the shaft 304.

The base 302 is sized to be received within the body 202 of the carrier 130 and form a seal (e.g., an interference fit) with the body 202 when received therein. Sealing of the base 302 within the body 202 of the carrier prevents the media 202 from leaking out of the carrier 130. Thus, an outer diameter of the base 302 may be substantially equal to but slightly smaller than an inner diameter of the body 202, such that the base 302 may be inserted into the body (e.g., via the open top or bottom end 204*a*, 204*b*) while providing a tight enough fit that a seal is formed between the base 302 and the body 202.

The shaft 304 extends along an axis A and includes a first end 308*a* and a second end 308*b* opposite the first end 308*a*. The base 302 is connected to the first end 308*a* of the shaft 304, such that the shaft 304 extends from the base 302 at the first end 308*a*. The spokes 306 are connected to (or form part of) the second end 308*b* of the shaft 304, and the spokes 306 extend radially outward from the shaft 304 and in a direction that is radially outward (e.g., perpendicular) from the axis A.

The shaft 304 has a smaller diameter than the base 302, such that a gap is defined between an outer surface of the shaft 304 and an inner surface of the body 202 of the carrier 130 (as well as an inner surface 310 of the tool body 104). As depicted, the spokes 306 extend radially outward from the axis A a sufficient amount such that they contact the inner surface 310 of the tool body 104. Thus, a diameter of the end cap 210 at the spokes 306 is substantially equal to and just slightly smaller than an inner diameter of the tool body 104, such that the spokes 306 may be inserted into the tool body 104 while making sufficient contact with the inner surface 310 of the tool body 104, such that the end cap 210 is firmly held and retained within the interior cavity 106 of the tool body 104 through the spokes 308 contacting the inner surface 310 of the tool body 104.

In the illustrated embodiment, the end cap 210 also includes a ring 312 extending from the base 302 and radially surrounding (extending about) the shaft 304 such that an annular space 314 is defined between the shaft 304 and the ring 312. As shown, an outer facing surface of the ring 312 faces and contacts the inner surface 310 of the tool body 104, whereas an inner facing surface 316 of the ring 312 faces and is spaced apart from an outer facing surface 318 of the shaft 304, such that the annular space 314 is defined between the inner facing surface 316 and the outer facing surface 318.

The end cap 210 also includes a flange 320 extending radially outward from the end of the ring 312 and abutting an end of the body 202 of the carrier 130. The flange 320 functions to limit the distance that the end cap 210 may be inserted into the body 202 of the carrier 130, as further axial movement of the end cap 210 into the body 202 along the axis A is inhibited once the flange 320 contacts the body 202. In the illustrated embodiment, the flange 320 includes an outer diameter that is substantially equal to an outer diameter of the body 202 of the carrier 130, such that an outwardly facing surface 322 of the flange 320 smoothly transitions into the outer surface 211 of the body 202.

In the illustrated embodiment, a plurality of slots 324 are formed at an end of the ring 312, and each of the spokes 306 extends radially outward from the axis and through one of the slots 324. Also, the slots 324 are located proximate to the flange 320 and the end of the body 202 that is in contact with the flange 320. The shaft 304 extends a suitable distance from the base 302, along the axis A, so as to position the spokes 306 at a location along the axis A where the spokes 306 are able to radially extend through the slots 324. The slots 324 are sized large enough such that one of the spokes 306 may extend radially therethrough, as shown in FIG. 5, without contacting any portion of the ring 312, so as to inhibit creation of a path for direct heat conduction between the spoke 306 and the ring 312. The end caps 210 depicted in the figures function to minimize contact with the tool body 104, while also being sufficiently robust to support and retain the carrier 130 against shocks and loads, and while also being capable of retaining the media 208 within the interior compartment 206 of the carrier 130.

Rather, as shown in FIG. 3, when the tool body 104 is heated, the heat will be conducted from the tool body 104 directly to the spokes 306 of the end cap 210, and that heat will then travel through the spokes and into the shaft 304, and then the heat will travel into the base 302. Once the base 302 of the end cap 210 has been heated, the heat will be conducted to the body 202 of the carrier 130 and the media 208. However, thermal conduction does not happen across the annular space 314 defined between the shaft 304 and the ring 312, the space in the slots 324 between the spokes 306 and the flange 320, or across the space 128 defined between the outer surface 211 of the carrier 130 and the inner surface 310 of the interior cavity 106 of the tool body 104. Thus, the end cap 210 creates a tortuous path for the heat to be conducted through the end cap 210, as it must travel through the spokes 306 and the shaft 304 before it reaches the base 302 that is in direct contact with the body 202 and the media 208, thereby reducing the rate of heat conduction and thermal bridging. By providing the end cap 210 with the tortuous path, it is possible to optimize and increase thermal conduction distance while keeping the overall length of the assembled component as short as possible.

Also, by recessing the shaft 304 within the ring 312 and forming the space 314 therebetween, and by positioning the spokes 306 and their corresponding slots 324 proximate to the end of the body 202, the majority of the surface area of the end caps 210 will be covered (e.g., by the body 202) and not directly facing the inner surface 310 of the interior cavity 106, which will thereby minimize the amount of heat (that is radiated from the inner surface 310) that is absorbed by the end caps 210. For example, as shown in FIG. 2, the majority of the end cap 210 is positioned within the body 202 of the carrier 130, and the only surface area that is facing the inner surface 310 of the interior cavity 106 is surface area of the spokes 306.

The end caps 210 operate to seal the media 208 within the carrier 130. In embodiments where the media 208 undergoes a solid to liquid phase change, the primary function of the end caps 210 is to seal the media 208 within the carrier 130 after the media 208 has transitioned to liquid phase. However, in embodiments, the end caps 210 may also operate to retain the media 208 when subjected to increased pressure, such as in cases where the phase change of the media 208 results in increased pressure. For example, if the media 208 undergoes phase change from liquid to gas, the volumetric change to gas would cause an increase in pressure within the interior compartment 206 of the carrier 130, and in such embodiments the end caps 210 will operate to retain the media 208 (regardless of what phase it is in) within the carrier 130 when under such increased pressure. For example, a seal may be provided between the end cap 210 and the body 202 to inhibit leaking of the media 208 when pressurized. In embodiments, the seal may be an O-ring or a gasket, or the end cap 210 may be bonded to the body 202 to facilitate sealing, and/or the end cap 210 and the body 202 may be crimped to facilitate sealing.

The end caps 210 may be made from various materials. In embodiments, one or both of the end caps 210 may be made of a polymer, e.g., polyether ether ketone (PEEK), polytetrafluoroethylene (PTEF), or nylon. However, other polymers and materials may be utilized to manufacture the end caps 210, such as Torlon, glass filled nylon, composites, thermoset plastics, etc. Also, in embodiments, the end caps 210 may be configured to have a low emissivity, for example, by polishing, plating, coating, or painting. Thus, in some embodiments the exposed surfaces of the end caps 210 (i.e., the exposed surfaces 315 of the spokes 306, axially facing surfaces 326, the inner facing surface 316, and the outer facing surface 318) may be highly polished, and/or may be plated or painted, as described above with reference to the outer surface 211 of the carrier 130.

Similarly, the inner surface 310 of the tool body 104 may be polished, plated, and/or painted to reduce emissivity. During use, heat from the tool body 104 will radiate from the inner surface 310 towards the carrier 130, and the rate that the heat radiates from the tool body 104 towards the carrier 130 will depend on the emissivity of the inner surface 310. Accordingly, treating the surface 310 with polishing, painting, and/or plating may reduce heat transfer via reducing emissivity, for example, as described above with reference to the outer surface 211 of the carrier 130 and as described above with reference to the exposed surfaces of the end caps 210.

As described above, the support mechanism utilized to suspend the carrier 130 within the tool body 104 may include one or more end caps, such as the end caps 210. However, in other non-illustrated embodiments, the support mechanism may include one or more brackets. For example, such a bracket may include a ring structure and a plurality of legs extending from the ring structure, wherein the ring structure surrounds and contacts the carrier body 202 and the legs project radially outward away from the ring structure and the carrier body 202 and contact the inner surface 310 of the tool body 104, such that heat will be conducted (from the tool body 104 to the carrier body 202) through the legs and the ring structure.

In some embodiments, the electronics 102 may be freely floating within the media 208 contained within the interior compartment 206 of the carrier 130. In other embodiments, the electronics 102 may be supported within the interior compartment 206 of the carrier 130 via one or more structures. FIG. 2 illustrates an example where a bracket 240 is utilized to support and position the interior compartment 206. Where utilized, the bracket 240 may position the electronics 102 in a desirable location within the interior compartment 206 where heat transfer (via conduction, convection, and/or radiation) will be minimized. For example, the bracket 240 may position the electronics 102 in a substantially central-located position within the interior compartment 206. In the illustrated embodiment, the bracket 240 is connected to and extends from the lower end cap 210*b*, however, it may instead be connected to and extend from the upper end cap 210*a*. In other embodiments, the bracket 240 may be connected to and extend from both the upper end cap 210*a* and the lower end cap 210*b*. In even other embodiments, the bracket 240 may be connected to and extend from an inner surface 242 of the body 202 of the carrier 130. Thus, a structure (such as the bracket 240) may be utilized to suspend the electronics 102 within interior compartment 206.

Thus, the upper end cap 210*a* and the lower end cap 210*b* suspend the carrier 130 within the interior cavity 106, space the carrier 130 from the internal sidewall of the interior cavity 106, provide a tortuous path for thermal conductivity and thermal bridging from points at which the upper end cap 210*a* and the lower end cap 210*b* contact the internal sidewall of the interior cavity 106 therethrough to the carrier 130, and limit surface area directly exposed to the inner surface 310 of the interior cavity 106 in order to minimize absorption of radiated heat. In addition, the upper end cap 210*a* and the lower end cap 210*b* may be constructed from and/or employ low-emissivity coating to also minimize absorption of radiated heat, retain the media 208 within the interior compartment 206 even when the media 208 undergoes volumetric expansion, and protect the electronics 102 from impact and mechanical loads.

In embodiments, the carrier 130 includes a geometry and/or features that reduce convection. For example, the outer surface 211 of the carrier 130 may include a geometry for reducing convection, wherein the geometry comprises slots, ribs, fins, etc. Similarly, the tool body 104 may include a geometry and/or features that reduces convection. For example, inner surface 310 of the interior cavity 106 may include geometry for reducing convection, wherein the geometry comprises slots, ribs, fins, etc.

Figure 7:
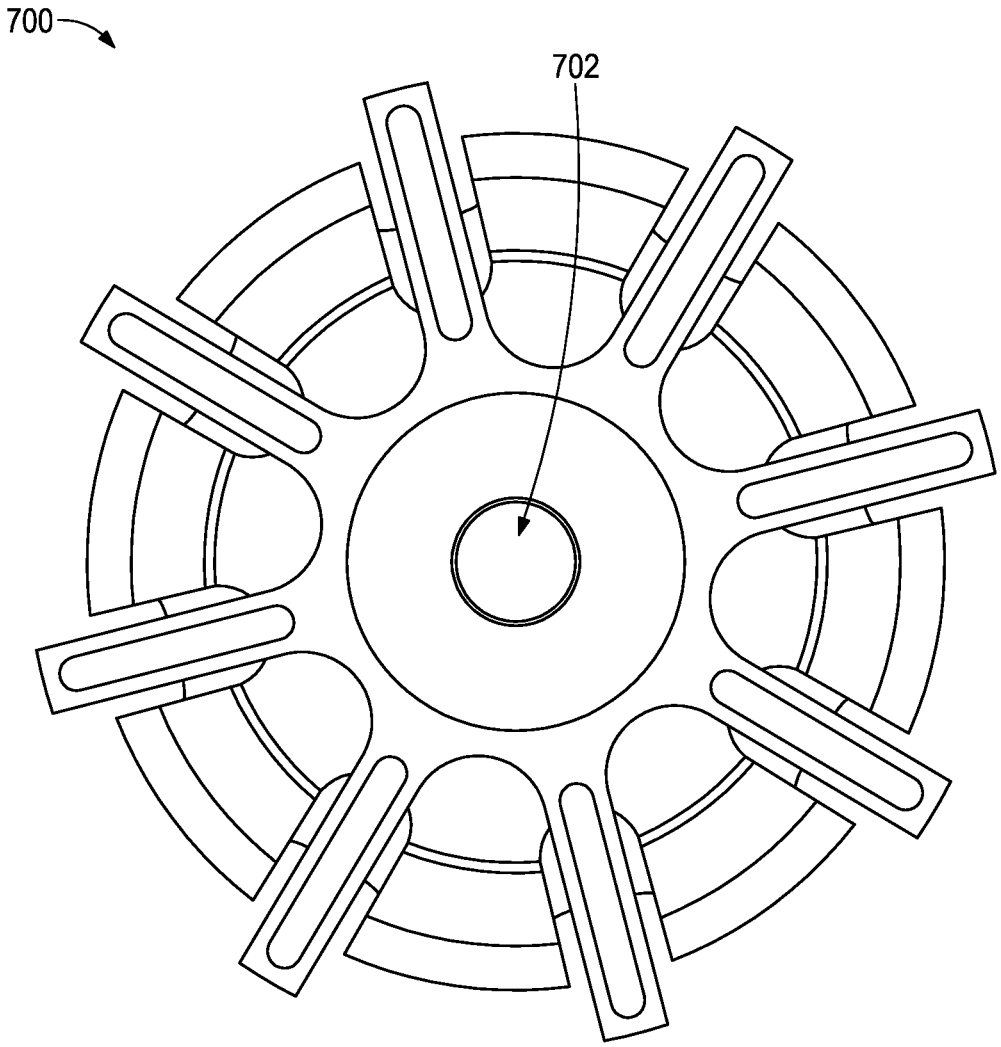
FIG. 7 is a front view of an alternate embodiment of an end cap, according to one or more alternate embodiments.

FIG. 7 illustrates an alternate embodiment of an end cap 700, according to one or more alternate embodiments. The end cap 700 is similar to the end cap 210, except that the end cap 700 includes a hole 702 that extends through the end cap 700. The hole 702 may be used for passing cables and wires through the end cap 700. Where utilized with the carrier 130, the hole 702 will provide access to the interior compartment 206 of the carrier 130 such that wiring and/or cables may be connected to the electronics 102 (FIGS. 1 and 2) and then fed back up to the surface. When in use, after connecting the cables and/or wires to the electronics 102, the hole 702 may be sealed with a material (e.g., a plug, a glue, etc.) to retain the media 108 within the interior compartment 206. In some embodiments, the end cap 700 is provided at just one end of the carrier 130, and with the other end of the carrier 130 being closed or having a different type of end cap (such as the end cap 210). In other embodiments, a pair of the end caps 700 may be used and installed on opposite ends of the carrier 130. While the hole 702 is illustrated as being singular and circular in FIG. 7, more or less than one hole may be used and/or the hole(s) may have one or more different shapes than as shown.

Figure 8:
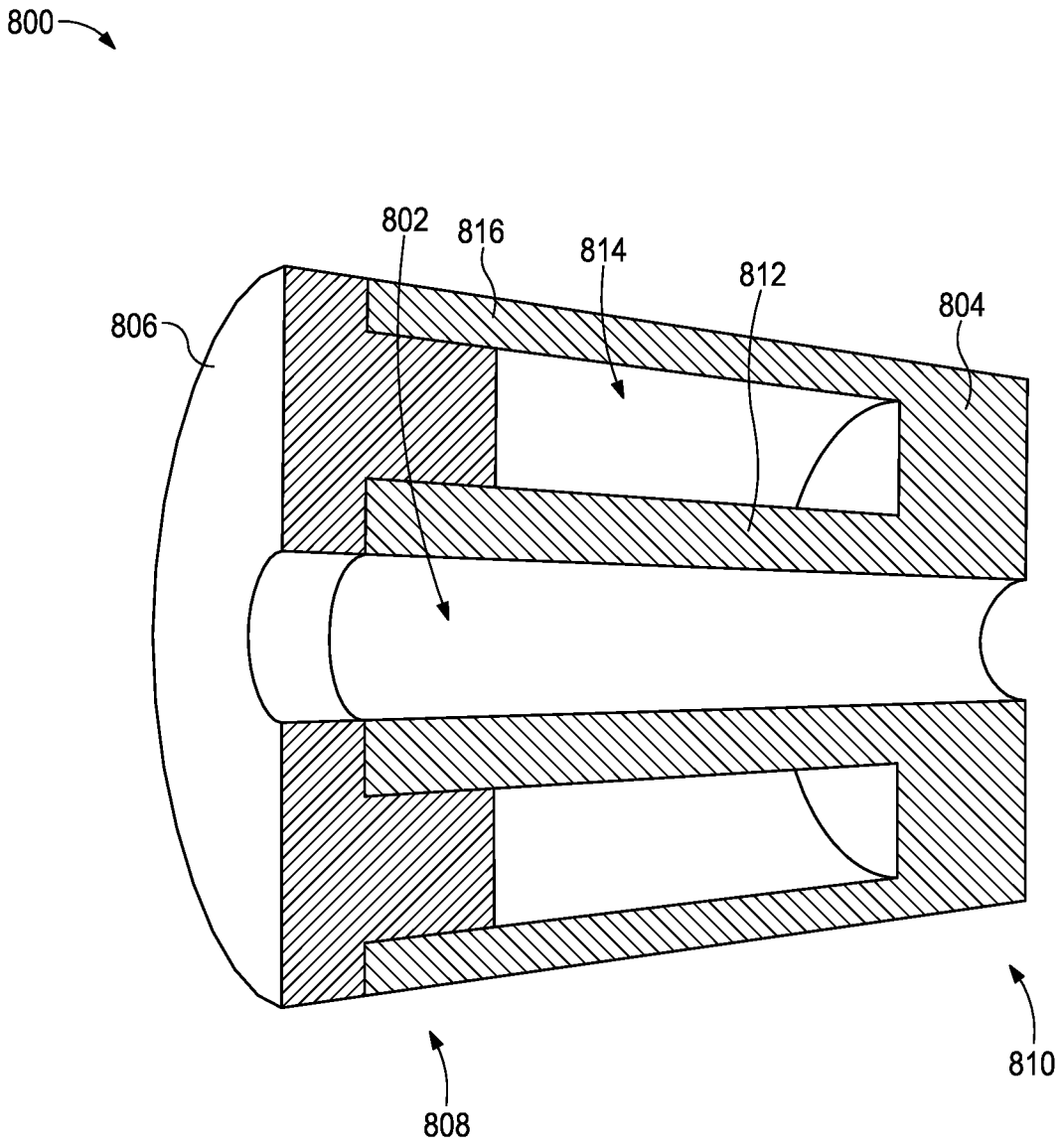
FIG. 8 is a cross sectional side view of an alternate embodiment of a carrier having a central channel, according to one or more alternate embodiments.

FIG. 8 illustrates an alternate embodiment of a carrier 800 having a central channel 802 (or thru-bore), according to one or more alternate embodiments. In the illustrated embodiment, the carrier 800 includes a carrier body 804 and an end cap 806 provided at a first end 808 of the carrier body 804. Also, the carrier 800 includes an interior compartment 814 within which a phase change media (not shown) may be provided. Here, the first end 808 of the carrier body 804 is open, such that the interior compartment 814 may be accessed via the first end 808 when the end cap 806 is removed, and the end cap 806 may be configured to close or seal the first end 808. A second end 810 of the carrier body 804 opposite the first end 808 may be closed, such that the interior compartment 814 may not be accessed via the second end 810. In other embodiments, however, the second end 810 may also be open such that the interior compartment 814 is accessible thereby and an end cap may be provided over the second end 810 to effectively close/seal it as shown with respect to the first end 808 and the end cap 806.

The central channel 802 is defined by an inner wall 812 of the carrier body 804, where the inner wall 812 extends through the interior compartment 814. As shown, the interior compartment 814 may be defined between the inner wall 812 of the carrier body 802, an outer wall 816 of the carrier body 804, the end cap 806 and the (closed) second end 810 of the carrier body 804. As shown, the central channel 802 extends through the carrier body 804 and the end cap 806, and the central channel 802 also extends through the (closed) second end 810. In these embodiments, the bulkheads 110 and the tool body 104 (FIG. 1) may also have a central channel that is in alignment with the central channel 802, such that items (e.g., tooling, wires, cables, etc.) may be extended through the entire system 100 (i.e., through the central channel of the tool body and bulkheads and the central channel 802), which may be beneficial and advantageous in applications where it is desirable to access deeper depths and areas beneath the system 100.

Referring again to the system 100 shown in FIGS. 1-3, during use, the system 100 is assembled by placing the electronics 102 in the interior compartment 206 of the carrier 130, filling the interior compartment 206 of the carrier 130 with the media 208 and sealing the interior compartment 206 via the end caps 210, and then installing the carrier 130 within the tool body 104 and attaching the bulkheads 110 to the tool body 104. The system 100 may then be inserted into a wellbore and lowered down the wellbore to the desired depth within the wellbore. As the system 100 is lowered into the wellbore, temperatures to which the system 100 is exposed will rise, and the increased temperature will conduct through the bulkheads 110 and the tool body 104 to the interior cavity 106 of the tool body 104. Heat (thermal energy) will then radiate from the inner surface 310 of the interior cavity 106 of the tool body 104 towards the carrier 130. The rate that heat radiates from the inner surface 310 of the tool body 104 will depend on the surface emissivity and, therefore, the inner surface 310 may be polished, plated, painted or similar to reduce the emissivity.

The heat radiating from the inner surface 310 of the tool body 104 will be absorbed by the carrier 130 (i.e., by both the carrier body 202 and the end caps 210). However, heat can only radiate to surfaces visible with 'line of sight' of the inner surface 310 of the tool body 104, and the rate at which radiated heat is absorbed depends on the surface emissivity. Thus, the outer surface of the components of the carrier 130 (i.e., the outer surface 211 of the carrier body 202 and/or exposed surfaces of the end caps 210 (i.e., the exposed surfaces 315 of the spokes 306, axially facing surfaces 326, the inner facing surface 316, and the outer facing surface 318)) may be polished, plated, painted or similar to reduce the emissivity, and/or the carrier body 202 and the end caps 210 may be made from a martial with low emissivity.

Where the interior cavity 106 is a full vacuum, there will be no convective heating to transfer heat from the tool body 104 and/or bulkheads 110 to the carrier 130 due to the presence of the vacuum. By providing a full vacuum in the interior cavity 106, the distance between the outer surface 211 of the carrier body 202 and the inner surface 310 of the interior cavity 106 of the tool body 104 may be very close together and, providing no physical contact is made, the heat transfer will be unchanged, as the radiated heat rate remains constant irrespective of distance between radiating and receiving surfaces in a full vacuum. However, where the interior cavity 106 is a partial vacuum, such partial vacuum would allow for some convective heating, albeit at a lower rate than if the interior cavity 106 is at full atmospheric pressure. Here, the gas composition within the interior cavity 106 will also affect the rate of partial vacuum convective heating and, therefore, a gas may be purged into the interior cavity 106 (prior to partial evacuation) that will help minimize convective heating.

Heat will also conduct where the carrier 130 contacts with the inner surface 310 of the tool body 104 and, in particular, heat will conduct from the tool body 104 to the carrier body 202 through the end caps 210. However, the design of the spokes 306 of the end caps 210 minimize contact area with the inner surface 310 to thereby minimize heat flow from the tool body 104. The geometry of the end caps 210 also provides a tortuous path for heat flow, which reduces thermal bridging, as the heat will need to flow through the spokes 306, the shaft 304, and then the base 302 of the end caps 210 before reaching the carrier body 202. Further, the end caps 210 may be made from a low thermal conductivity material, which can help reduce the rate of conductive heat transfer to the carrier body 202. However, in embodiments, only a portion of the conductive path defined by the end caps 210 is made from a low thermal conductivity material.

The various components of the carrier 130 (i.e., the carrier body 202 and the end caps 210) together define a thermal mass (the sum of the individual component masses multiplied by their individual specific heat capacities), and the rate of temperature rise will depend on the rate of heat input and the total thermal mass being heated. The media 208 contained in the interior compartment 206 will add thermal mass to the carrier 130, which will beneficially result in a lower temperature rise for a given energy input than would otherwise occur if the carrier 130 were not filled with the media 208.

As tool body 104 temperature rises, thermal inputs to the carrier 130 serve to heat the media 208 contained in the carrier 130, and the media 208 will increase in temperature until it reaches its phase transition temperature. At the phase transition temperature, the media 208 will change phase (e.g., solid to liquid, or liquid to gas, or solid to gas). Phase change requires energy input (i.e., latent heat of solidification for a solid to liquid or latent heat of vaporization for a liquid to gas) and, during this phase change, the temperature remains (virtually) constant for a period of time while additional energy is being input. This time period when the phase change in the media 208 occurs will provide additional time that the electronics 102 is able to function/operate. After the time period, and assuming the system 100 is still located at depth and exposed to such enhanced temperatures and pressures, the media 208 will have undergone such phase change, such that the temperature within the interior compartment 206 will rise with further energy input and eventually reach equilibrium with the external environment, and such rising temperatures may damage/destroy the electronics 102. Thus, the additional "survival time" provided by the phase change of the media 208 effectively extends the mission operability to a useful duration beyond that if the media 208 (i.e., a phase change material) were not present.

When the temperature of the tool body 104 drops, the reverse process happens. The media 208 will start cooling until the media 208 reaches the phase transition temperature and will change phase. During the phase change, the temperature of the media 208 will remain (virtually) constant while heat is lost from the media 208 through the carrier 130 and into the tool body 104 and external environment. After the media 208 has solidified, the temperature of the media 208 will continue to fall.

In embodiments, the electronics 102 may be configured to sense and/or react to the phase change of the media 208. For example, where the media 108 is a conductive material and where the electronics 102 are surrounded by and in intimate contact with the media 208, the media 208 may cause the closing of a circuit in the electronics 102 when it changes phases, and the closing of the circuit in the electronics 102 may cause the electronics 102 to automatically switch to a hibernation mode (i.e., cause the electronics 102 to hibernate). This feature could in turn could allow a tool to remain unpowered for an extended period and only activated at a particular temperature threshold or when descending below a certain temperature. In another example, the electronics 102 may be configured to sense volume change within the interior compartment 206, for example, as the media 208 changes phases from solid to liquid (i.e., liquefies). Here, the electronics 102 may include a temperature sensor and/or a pressure sensor and the electronics 102 will automatically switch to hibernation mode upon sensing a certain temperature/pressure increase which indicates that the media 208 has changed phases. For example, upon sensing a certain pressure or temperature threshold (i.e., a pressure or temperature at or above the phase change value which is given for the particular media utilized), the programmed logic of the electronics 102 would initiate a hibernation routine which thereby switches it into the hibernation mode.

As described above, the system 100 will maintain the carrier 130 at a lower temperature than the tool body 104 during use in a wellbore, such that a temperature difference exists. Thus, in embodiments, a Peltier may be utilized to generate power where a suitable temperature difference between the tool body 104 and the carrier 130 is present. For example, the electronics 102 may draw power from a Peltier (i.e., the electronics may be powered by a Peltier), such that the electronics 102 would not require an onboard battery or a power cable extending to the surface.

Embodiments disclosed herein include:

A. A downhole electronics enclosure system comprising: a tool body defining an interior cavity; a carrier body removably provided within the interior cavity, the carrier body defining an interior compartment for receiving electronics; a phase change media sealed within the interior compartment of the carrier body; and a support mechanism that suspends the carrier body within the interior cavity of the tool body, such that a space is defined between an outer surface of the carrier body and an inner surface of the tool body.

B. A carrier for housing electronics within a downhole tool comprising: a carrier body defining an open top end, an interior compartment, and an open bottom end, wherein the open top end and the open bottom end are in communication with the interior compartment; an upper end cap provided at the open top end of the carrier body and generating a sealed interface with the open top end; a lower end cap provided at the open bottom end of the carrier body and generating a sealed interface at the open bottom end; and a phase change media sealed within the interior compartment of the carrier body via the upper end cap and the lower end cap, wherein: the upper end cap and the lower end cap each include a shaft, a plurality of spokes extending from a first end of the shaft, and a base extending from a second end of the shaft, the base is disposed within either the open top end or the open bottom end of the carrier body, and the plurality of spokes radial extend from the shaft for suspending the carrier body such that heat is conducted to the carrier body through the plurality of spokes, the shaft, and the base.

C. A method comprising: providing electronics within an interior compartment of a carrier body; sealing a phase change media within the interior compartment via at least one end cap, wherein the carrier body having the at least one end cap sealed thereon defines a carrier; suspending the carrier within an interior cavity of a tool body, such that a space is defined between an outer surface of the carrier body and an inner surface of the tool body; and at least partially evacuating air or gas from the space between the carrier body and the tool body.

Each of embodiments A through C may have one or more of the following additional elements in any combination: Element 1: wherein the phase change media comprises a paraffin wax. Element 2: wherein the support mechanism comprises an upper end cap arranged around an open top end of the carrier body and a lower end cap arranged around an open bottom end of the carrier body, such that the carrier body is suspended within the interior cavity of the tool body via the upper end cap and the lower end cap. Element 3: wherein the upper end cap and the lower end cap each include a base, a shaft extending axially from the base, and a plurality of spokes extending radially outward from an end of the shaft, wherein the plurality of spokes contact the inner surface of the tool body and the base contacts the carrier body such that heat is conducted to the carrier body through the plurality of spokes, the shaft, and the base. Element 4: wherein the upper end cap and/or the lower end cap comprises an interior bracket extending into the interior cavity for supporting electronics contained within the carrier body. Element 5: wherein the upper and lower end caps are made of a polymer selected from the group consisting of polyether ether ketone (PEEK), polytetrafluoroethylene (PTEF), and nylon. Element 6: wherein an exterior surface of the upper end cap and an exterior surface of the lower end cap are polished, and/or the exterior surface of the upper end cap and the exterior surface of the lower end cap comprise a low-emissivity plating and/or a low-emissivity paint. Element 7: wherein the upper end cap and/or the lower end cap comprises a hole through which the interior compartment of the carrier body may be accessed. Element 8: further comprising: an upper bulkhead provided at an upper end of the tool body; and a lower bulkhead provided at a lower end of the tool body. Element 9: wherein the outer surface of the carrier body is polished, and/or the outer surface of the carrier body comprises a low-emissivity plating and/or a low-emissivity paint; and/or the inner surface of the tool body which at least partially defines the interior cavity is polished, and/or the inner surface comprises a low-emissivity plating and/or a low-emissivity paint. Element 10: wherein the tool body includes a vacuum port extending into the interior cavity for pressurizing the interior cavity, the downhole electronics enclosure system further comprising a seal plug removably provided over an opening to the vacuum port, wherein the vacuum port comprises a check valve; and wherein the tool body includes opposing upper and lower ends, and the vacuum port is provided at the upper end, the downhole electronics enclosure system further including an upper bulkhead removably provided at the upper end of the tool body such that the upper bulkhead covers the vacuum port when installed on the tool body. Element 11: a gas is injected into the space defined between the carrier body and the interior cavity of the tool body, wherein the gas has lower heat transfer properties than air and comprises Nitrogen, Argon, or dry air; or an aerogel and/or an open cell foam is injected into the space defined between the outer surface of the carrier body and the inner surface of the tool body. Element 12: wherein the outer surface of the carrier body provides at least one of slots, ribs, and/or fins for reducing convection. Element 13: wherein the phase change media is a conductive material in intimate contact with the electronics and the phase change media liquefies upon phase change, and, when the electronics are contacted by liquefied media, the electronics are automatically switched into a hibernation mode. Element 14: further comprising a sensor configured to detect temperature change and/or pressure change, wherein the electronics are configured to automatically switch into a hibernation mode upon detecting a threshold temperature and/or a threshold pressure. Element 15: further comprising a Peltier element operable to provide power to the electronics.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A downhole electronics enclosure system, comprising:

a tool body defining an interior cavity providing an inner surface with a first diameter;

a carrier body removably provided within the interior cavity, the carrier body providing an outer surface along an entire length of the carrier body with a second diameter and defining an interior compartment for receiving electronics;

a phase change media sealed within the interior compartment of the carrier body; and a support mechanism that suspends the carrier body within the interior cavity of the tool body, wherein the first diameter is greater than the second diameter such that the outer surface of the carrier body does not contact the inner surface of the tool body.

2. The downhole electronics enclosure system of claim 1, wherein the phase change media comprises a paraffin wax.

3. The downhole electronics enclosure system of claim 1, wherein the support mechanism comprises an upper end cap arranged around an open top end of the carrier body and a lower end cap arranged around an open bottom end of the carrier body, such that the carrier body is suspended within the interior cavity of the tool body via the upper end cap and the lower end cap.

4. The downhole electronics enclosure system of claim 3, wherein the upper end cap and the lower end cap each include a base, a shaft extending axially from the base, and a plurality of spokes extending radially outward from an end of the shaft, wherein the plurality of spokes contact the inner surface of the tool body and the base contacts the carrier body such that heat is conducted to the carrier body through the plurality of spokes, the shaft, and the base.

5. The downhole electronics enclosure system of claim 3, wherein the upper end cap and/or the lower end cap comprises an interior bracket extending into the interior cavity for supporting electronics contained within the carrier body.

6. The downhole electronics enclosure system of claim 3, wherein the upper and lower end caps are made of a polymer selected from the group consisting of polyether ether ketone (PEEK), polytetrafluoroethylene (PTEF), and nylon.

7. The downhole electronics enclosure system of claim 3, wherein an exterior surface of the upper end cap and an exterior surface of the lower end cap are polished, and/or the exterior surface of the upper end cap and the exterior surface of the lower end cap comprise a low-emissivity plating and/or a low-emissivity paint.

8. The downhole electronics enclosure system of claim 3, wherein the upper end cap and/or the lower end cap comprises a hole through which the interior compartment of the carrier body may be accessed.

9. The downhole electronics enclosure system of claim 1, further comprising:

an upper bulkhead provided at an upper end of the tool body; and a lower bulkhead provided at a lower end of the tool body.

10. The downhole electronics enclosure system of claim 1, wherein the outer surface of the carrier body is polished, and/or the outer surface of the carrier body comprises a low-emissivity plating and/or a low-emissivity paint; and/or the inner surface of the tool body which at least partially defines the interior cavity is polished, and/or the inner surface comprises a low-emissivity plating and/or a low-emissivity paint.

11. The downhole electronics enclosure system of claim 1, wherein the tool body includes a vacuum port extending into the interior cavity for pressurizing the interior cavity, the downhole electronics enclosure system further comprising a sealing plug removably provided over an opening to the vacuum port, wherein the vacuum port comprises a check valve; and wherein the tool body includes opposing upper and lower ends, and the vacuum port is provided at the upper end, the downhole electronics enclosure system further including an upper bulkhead removably provided at the upper end of the tool body such that the upper bulkhead covers the vacuum port when installed on the tool body.

12. The downhole electronics enclosure system of claim 1, wherein either:

a gas is injected into a space defined between the carrier body and the interior cavity of the tool body, wherein the gas has lower heat transfer properties than air and comprises Nitrogen, Argon, or dry air; or an aerogel and/or an open cell foam is injected into the space defined between the outer surface of the carrier body and the inner surface of the tool body.

13. The downhole electronics enclosure system of claim 1, wherein the outer surface of the carrier body provides at least one of slots, ribs, and/or fins for reducing convection.

14. The downhole electronics enclosure system of claim 1, wherein the phase change media is a conductive material in intimate contact with the electronics and the phase change media liquefies upon phase change, and, when the electronics are contacted by liquefied media, the electronics are automatically switched into a hibernation mode.

15. The downhole electronics enclosure system of claim 1, further comprising a sensor configured to detect temperature change and/or pressure change, wherein the electronics are configured to automatically switch into a hibernation mode upon detecting a threshold temperature and/or a threshold pressure.

16. A carrier for housing electronics within a downhole tool, comprising:

a carrier body defining an open top end, an interior compartment, and an open bottom end, wherein the open top end and the open bottom end are in communication with the interior compartment;

an upper end cap provided at the open top end of the carrier body and generating a sealed interface with the open top end;

a lower end cap provided at the open bottom end of the carrier body and generating a sealed interface at the open bottom end; and a phase change media sealed within the interior compartment of the carrier body via the upper end cap and the lower end cap, wherein:

the upper end cap and the lower end cap each include a shaft, a plurality of spokes extending from a first end of the shaft, and a base extending from a second end of the shaft, the base is disposed within either the open top end or the open bottom end of the carrier body, and the plurality of spokes radially extend from the shaft for suspending the carrier body such that heat is conducted to the carrier body through the plurality of spokes, the shaft, and the base.

17. The carrier of claim 16, wherein an outer surface of the carrier body comprises a geometry for reducing convection, the geometry being selected from the group consisting of slots, ribs, and fins.

18. The carrier of claim 16, wherein an exterior surface of the upper end cap and an exterior surface of the lower end cap are polished, and/or the exterior surface of the upper end cap and the exterior surface of the lower end cap are covered with a low-emissivity plating and/or a low-emissivity paint; and/or an outer surface of the carrier body is polished, and/or the outer surface of the carrier body is covered with a low-emissivity plating and/or a low-emissivity paint.

19. A method, comprising:

providing electronics within an interior compartment of a carrier body;

sealing a phase change media within the interior compartment via at least one end cap, wherein the carrier body having the at least one end cap sealed thereon defines a carrier;

suspending the carrier within an interior cavity of a tool body such that an outer surface defined along an entire length of the carrier body does not contact an inner surface of the tool body; and at least partially evacuating air or gas from a space defined between the carrier body and the tool body.

20. The carrier of claim 16, wherein an outer diameter of each of the upper and lower end caps at the plurality of spokes is greater than an outer diameter of the carrier body.

* * * * *